US008844985B2

(12) United States Patent
Liang et al.

(10) Patent No.: US 8,844,985 B2
(45) Date of Patent: Sep. 30, 2014

(54) FORCE ENTRY RESISTANT SASH LOCK

(75) Inventors: Luke Liang, South Plainfield, NJ (US); Tong Liang, Guang Zhou (CN); David Chen, Guang Zhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 0 days.

(21) Appl. No.: 13/283,976

(22) Filed: Oct. 28, 2011

(65) Prior Publication Data

US 2012/0313386 A1 Dec. 13, 2012

Related U.S. Application Data

(60) Provisional application No. 61/520,623, filed on Jun. 10, 2011.

(51) Int. Cl.
*E05C 3/16* (2006.01)

(52) U.S. Cl.
USPC ..... 292/242; 292/163; 292/DIG. 20; 292/DIG. 47; 70/89; 70/90; 49/449

(58) Field of Classification Search
USPC ..... 292/95, 121, 124, 126, 128, 98, 292/100–103, 107, 108, 240–242, 194, 224, 292/226, 228, 197, 200, 202–204, 209, 210, 292/DIG. 20, DIG. 47, DIG. 61; 49/449
See application file for complete search history.

(56) References Cited

U.S. PATENT DOCUMENTS

| | | | | | |
|---|---|---|---|---|---|
| 684,497 | A * | 10/1901 | Davies | 292/31 |
| 4,261,602 | A * | 4/1981 | Anderson | 292/143 |
| 5,452,925 | A * | 9/1995 | Huang | 292/57 |
| 5,542,158 | A * | 8/1996 | Gronau et al. | 24/295 |
| 5,662,375 | A * | 9/1997 | Adams et al. | 296/214 |
| 5,775,860 | A * | 7/1998 | Meyer | 411/46 |
| 6,588,150 | B1 * | 7/2003 | Wong et al. | 49/183 |
| 7,159,908 | B2 * | 1/2007 | Liang | 292/242 |
| 2007/0158953 | A1 * | 7/2007 | Liang | 292/197 |
| 2010/0218425 | A1 * | 9/2010 | Nolte et al. | 49/185 |
| 2011/0271720 | A1 * | 11/2011 | Zheng | 70/89 |
| 2011/0304163 | A1 * | 12/2011 | Liang et al. | 292/242 |

* cited by examiner

*Primary Examiner* — Kristina Fulton
*Assistant Examiner* — Thomas Neubauer
(74) *Attorney, Agent, or Firm* — Thomas A. O'Rourke; Bodner & O'Rourke, LLP

(57) ABSTRACT

An improved forced entry resistant sash lock comprises a housing, a shaft rotatably mounted thereto, a locking cam and a delay cam rotatably and fixedly mounted to the shaft, respectively, and a locking spring. The delay cam selectively engages and drives the locking cam between a locked position and an unlocked position. Locking spring biasing causes engagement with a locking earn opening to lock the cam when in the latch-locked position, with engagement to a depth permitting releasable detent engagement in a delay cam recess. Selective engagement and driving of the locking cam comprises a first portion of delay cam rotation being without driven locking cam rotation, and a second portion causing driven locking cam rotation from a retracted position into a protruding position. Selective engagement is by contact between corresponding protrusions on the delay and locking cams. Shaft/delay cam counter-rotation to unlock the latch proceeds in a reverse manner.

26 Claims, 16 Drawing Sheets

FIG. 13D

Handle: Rotated 180 Degrees
Lock Condition: Locked
Locking Cam: Protruding & Locked
Delay Cam: Detent Secured

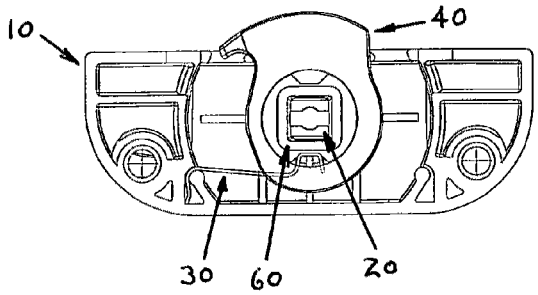

FIG. 13E

Handle: Counter-Rotated 85-90 Deg.
Lock Condition: Locked
Locking Cam: Protruding, Detent Secured
Delay Cam: Counter-Rotating Independently

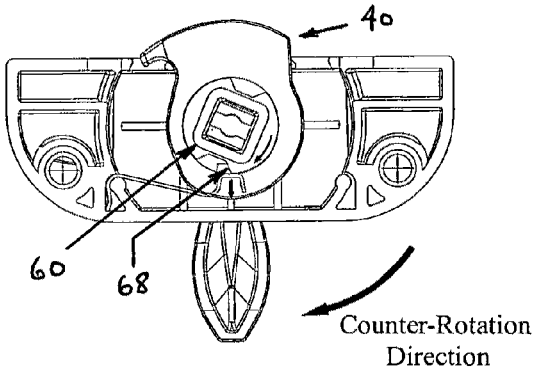

FIG. 13F

Handle: Counter-Rotated Over ~ 90 Deg.
Lock Condition: Unlocked
Locking Cam: Driven Counter-Rotation
Delay Cam: Counter-Rotating &
Driving Locking Cam

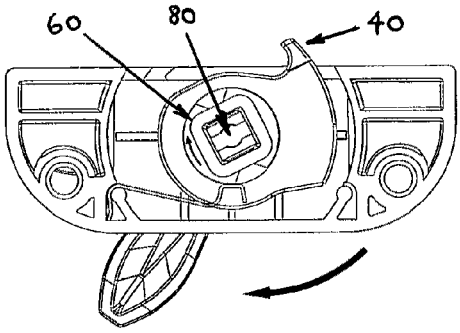

FIG. 13G

Handle: Counter-Rotated 180 Deg.
Lock Condition: Unlocked
Locking Cam: Retracted, Detent Secured
Delay Cam: Detent Secured

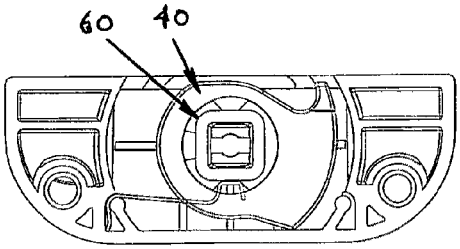

FORCE ENTRY RESISTANT SASH LOCK

CROSS REFERENCES TO RELATED APPLICATIONS

This application claims priority on U.S. Provisional Application Ser. No. 61/520,623 filed on Jun. 10, 2011, the disclosures of which are incorporated herein by reference.

FIELD OF THE INVENTION

The present invention is directed to the field of window locks and more particularly sash locks. The sash locks of the present invention are more resistant to forced entry than traditional locks.

BACKGROUND OF THE INVENTION

Sliding windows, double hung windows, and single hung windows are three common types of windows known in the art. Sash locks frequently are used to secure the sash or sashes to prevent them from opening.

One type of sash lock that has recently been marketed is known as a forced-entry resistant (FER) lock. The testing for forced entry resistant locks may be found, for example, in a standard promulgated by ASTM International (formerly the American Society for Testing and Materials), which is F588-04, "Standard Test Method for Measuring the Forced Entry Resistance of Window Assemblies, Excluding Glazing Impact."

Examples of forced entry resistant sash locks are shown in: U.S. application Ser. No. 12/587,377, filed Oct. 6, 2009; U.S. application Ser. No. 11/649,729, filed Jan. 4, 2007; and U.S. Pat. No. 7,159,908, the disclosures of which are incorporated herein by reference.

SUMMARY OF THE INVENTION

A window latch may comprise a housing, a shaft being rotatably mounted in a housing orifice, a locking cam being rotatably mounted upon the shaft within a cavity of the housing, a delay cam being fixedly mounted to the shaft, and a locking spring being installed in the housing cavity. A portion of the delay cam may be received within a portion of the locking cam to thereby selectively engage and drive the locking cam between a first position in which the latch is unlocked, and a second position in which the latch is locked. The locking spring may have a first end secured to the housing such that its second end is biased into contact with the locking cam. The biased locking spring may engage a first opening in the locking cam to lock the locking cam relative to the housing upon the locking cam reaching the second position (latch locked). The engagement of the second end of the locking spring within the locking cam may be to a depth sufficient to further permit engagement of the second end of the spring therein with a first chamfered recess in the delay cam to thereby serve as a detent to releasably retain the delay cam and shaft in the second position.

The delay cam selectively engaging and driving the locking cam may comprise, upon rotation of the shaft and delay cam from the first position to the second position, a first portion of the rotation of the delay cam being without driven rotation of the locking cam; and a second portion of the rotation of the delay cam causing rotation of the locking cam to thereby drive the locking cam from an retracted position being within the housing, into an extended position being with a portion of the locking cam protruding out from the housing cavity. The second portion of the rotation of the delay cam causing driven rotation of the locking cam may be by a protrusion on the delay cam being positioned thereon to engage a corresponding protrusion on the locking cam, after the first portion of the shaft/delay cam rotation has occurred. The first portion of the rotation of the delay cam may be for approximately 85 to 90 degrees of rotation, where the first and second portions of rotation of the delay cam may together comprises approximately 180 degrees of rotation. The locking cam rotation between the retracted and the extended positions may comprise approximately 90 degrees of rotation.

The delay cam selectively engaging and driving the locking cam may further comprise, upon counter-rotation of the shaft and delay cam from the second position to the first position: a first portion of the counter-rotation of the delay cam being without driven counter-rotation of the locking cam, and second portion being with driven counter-rotation. The first portion of the delay cam counter-rotation may initially be with the first chamfered recess counter-rotating to cause partial disengagement of the locking spring second end from the locking cam first opening, with the partial disengagement resulting in an angled surface of the locking spring contacting an edge of the locking cam first opening to serve as a detent. The second portion of the counter-rotation of the delay cam may cause counter-rotation of the locking cam and complete disengagement of the locking spring from the edge of the locking cam, to thereby drive the locking cam from the extended position into the retracted position. The second portion of the counter-rotation of the delay cam causing driven counter-rotation of the locking cam may be by a second protrusion on the delay cam being positioned thereon to engage a second protrusion on the locking cam, after the first portion of the corresponding shaft/delay cam counter-rotation has occurred.

The locking cam may further comprise a second opening to receive the locking spring second end to form a detent, so that when the locking cam is driven into the retracted position, the biased second end of the locking spring may engage the second opening in the locking cam. The second opening may be chamfered to permit the locking spring second end to be releasable therefrom upon rotation of the shaft. Also, the delay cam may further comprise a second recess, so that when the locking cam is driven into the retracted position, the biased second end of the locking spring may engage the second opening in the locking cam to a depth to further permit engagement of the spring therein with the second recess of the delay cam. The second recess of the delay cam may also be chamfered to permit the locking spring second end to be releasable therefrom upon rotation of the shaft.

BRIEF DESCRIPTION OF THE DRAWINGS

FIG. 13D-13G is a sequence of views showing the locking cam positioning as the shaft of the latch is actuated to move the latch from being in the latch locked position (13D) to the latch unlocked position (13G).

DETAILED DESCRIPTION OF THE INVENTION

Figure 1B:
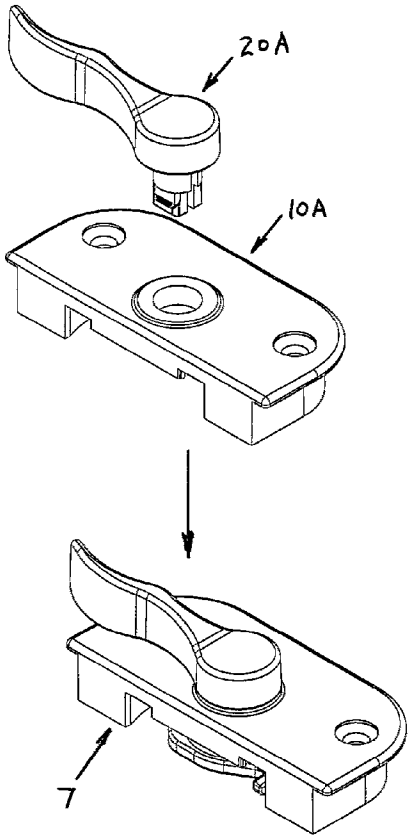
FIG. 1B shows an alternate assembled view that may be created using an alternate housing and a different shaped graspable handle.
Figure 1:
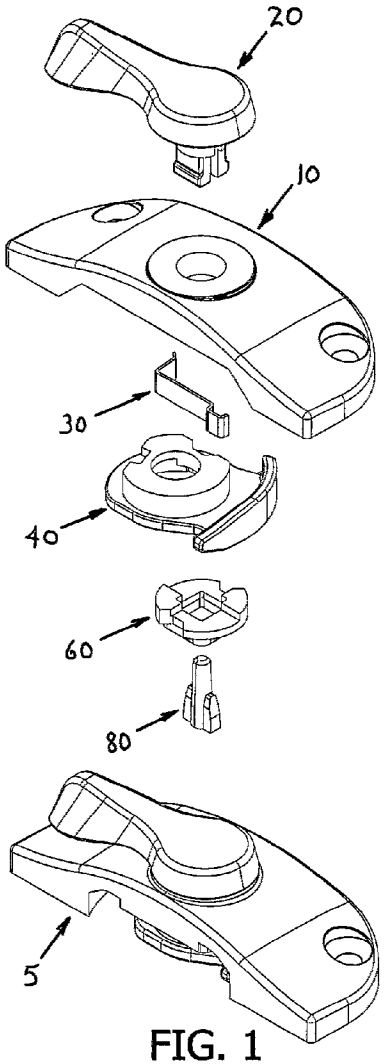
FIG. 1 is an assembled view and an exploded view of the parts comprising a first embodiment of the force resistant lock of the present invention.
Figure 1A:
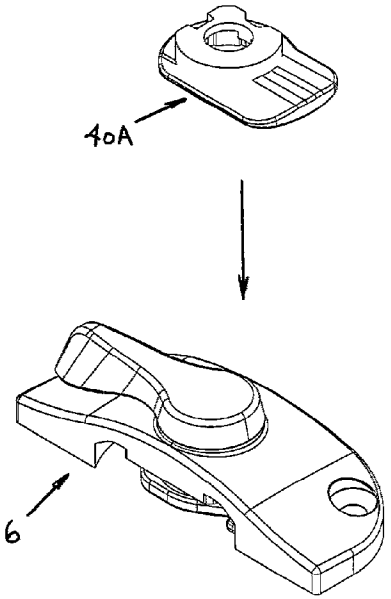
FIG. 1A shows an alternate assembled view that may be created using an alternate locking earn.

FIG. 1 shows a first embodiment of the improved force resistance sash lock 5 of the present invention, which comprises a housing 10, a shaft/handle member 20, a locking spring 30, a locking cam 40, a delay cam 60, and a wedge member 80. As may be seen in FIG. 1A, an alternate embodiment may be formed by using a modified locking cam 40A to create lock 6, while another alternate embodiment shown in FIG. 1B may be formed by using a modified housing 10A along with a modified shaft/handle 20A to create lock 7. The locks 5, 6, or 7 may be secured to one sash member, and may, by engagement of its locking cam with a keeper that is secured to another sash member or another part of the window, lock the slidable sash member and prevent unauthorized entry into a dwelling. An additional feature of the lock disclosed herein is it capability to generally resist a forced entry, which is accomplished, in addition to the locking of the sash, by the locking of the cam that engages the keeper, so that attempts to simply slide a lock-picking device between the sashes to counter-rotate the cam will be unsuccessful. Also, another feature disclosed hereinafter, whereby the shaft/handle member 20 must necessarily rotate approximately 85-90 degrees before it begins to cause the delay cam to drive the locking cam from the latch locked position, further serves to resist a forced entry.

Figure 14:
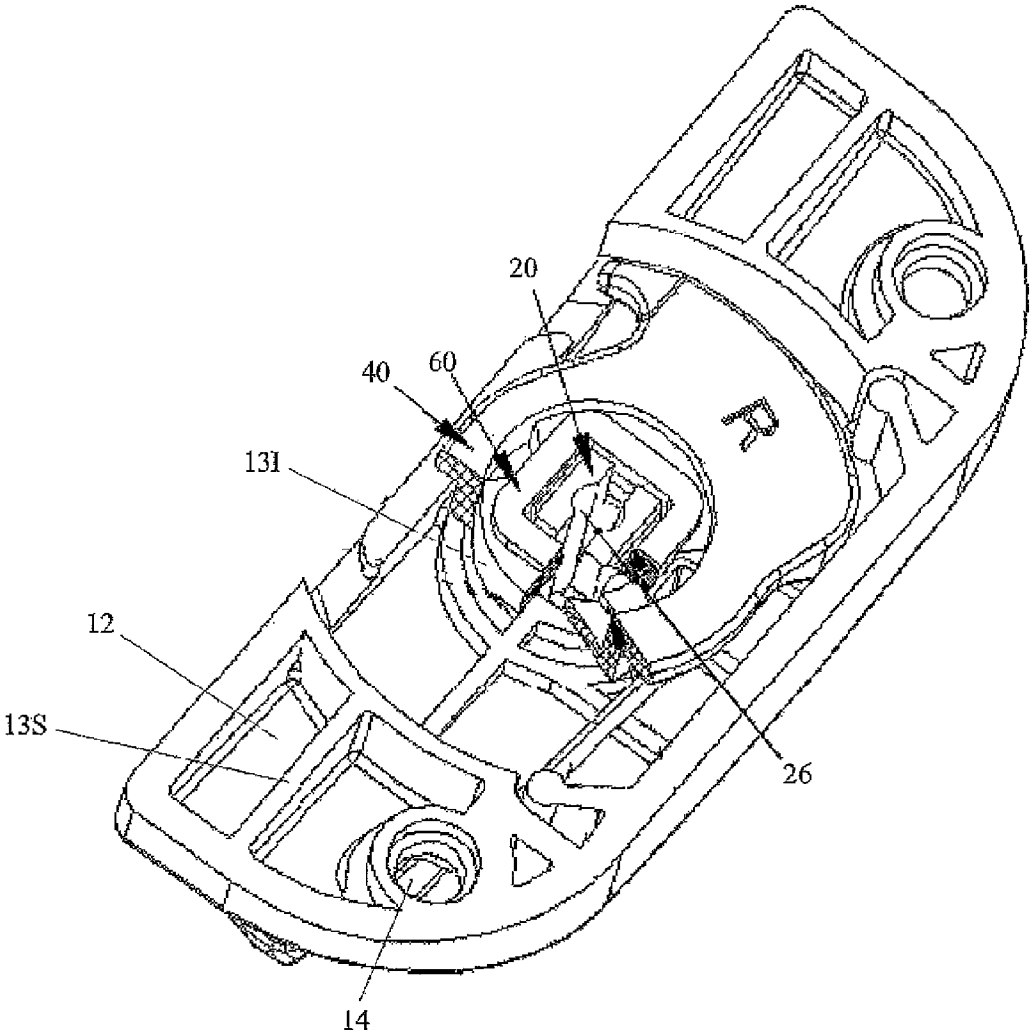
FIG. 14 is a perspective view of the bottom of the forced entry resistance lock of FIG. 1, with portions of the delay cam and locking cam cut away to reveal housing interior details.
Figure 15:
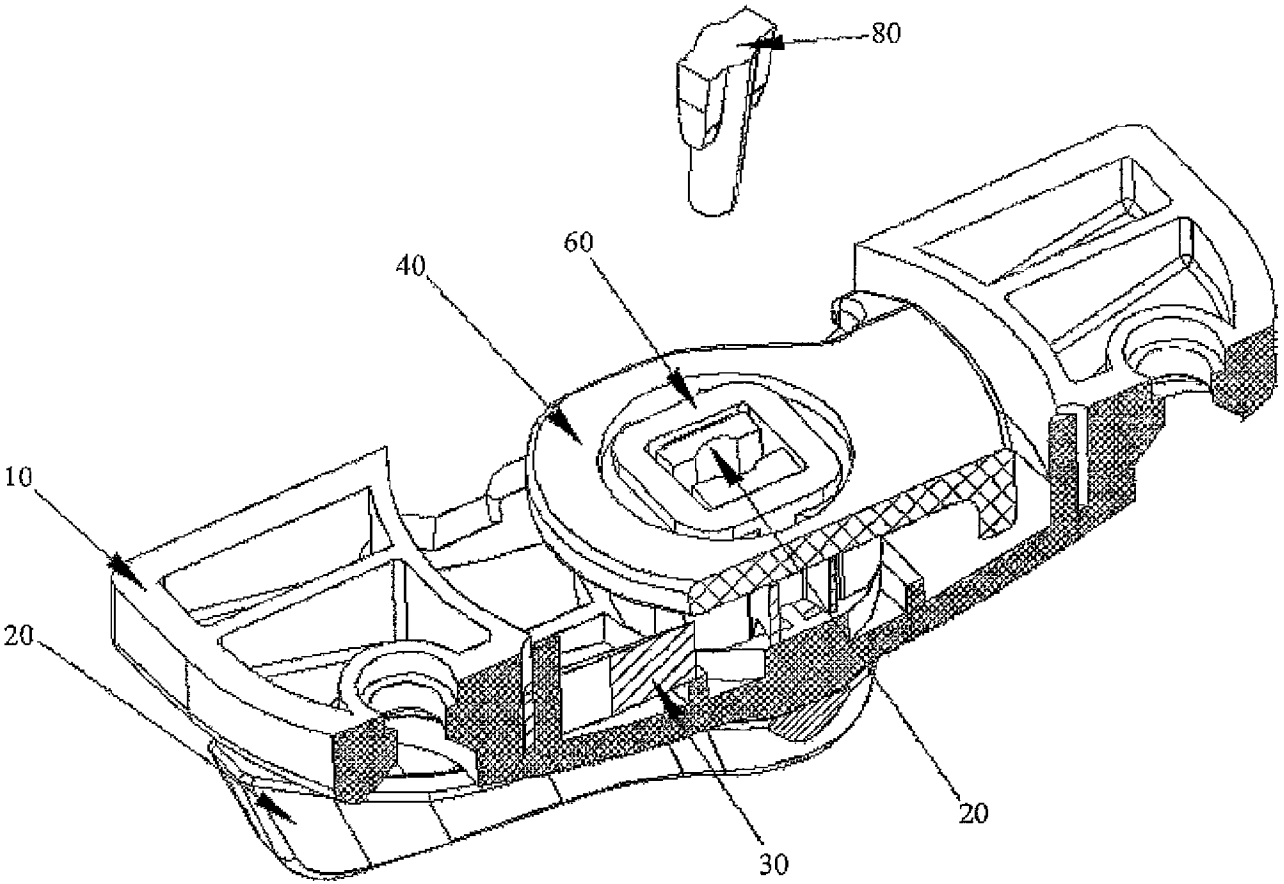
FIG. 15 is a perspective view of the bottom of the forced entry resistance lock of FIG. 1, with portions of the housing and locking cam cut away to reveal the locking recess of the locking cam that corresponds to the locking spring.
Figures 16A, 16B, 16C, 16D, 16E, 16F:
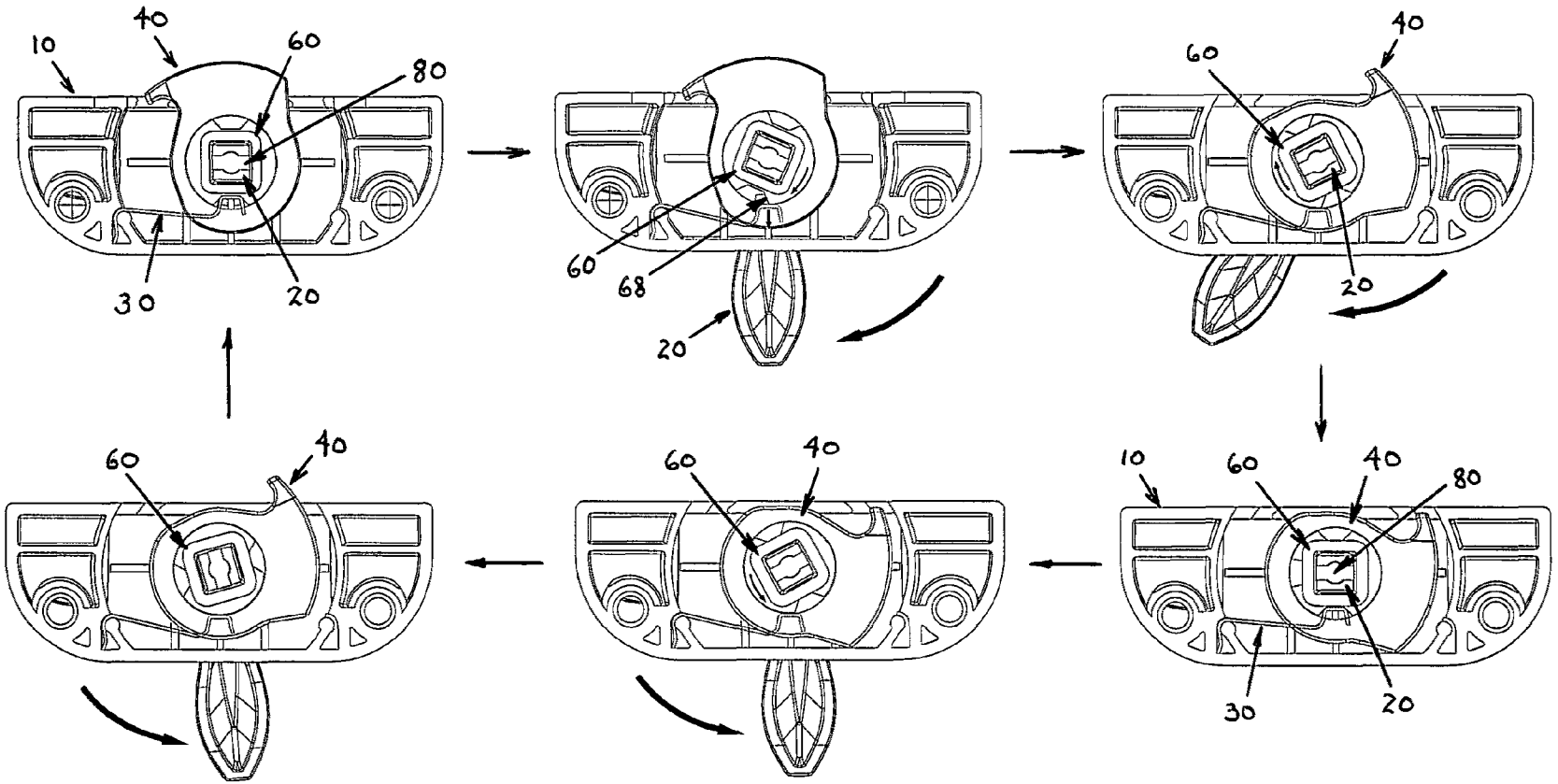
FIG. 16A-16F is a sequence of bottom views of the lock of FIG. 1, showing corresponding positions for the locking cam, and the shaft with graspable handle, throughout movement of the lock from the locked position to the unlocked position and back to the locked position.
Figures 17A, 17B, 17C, 17D:
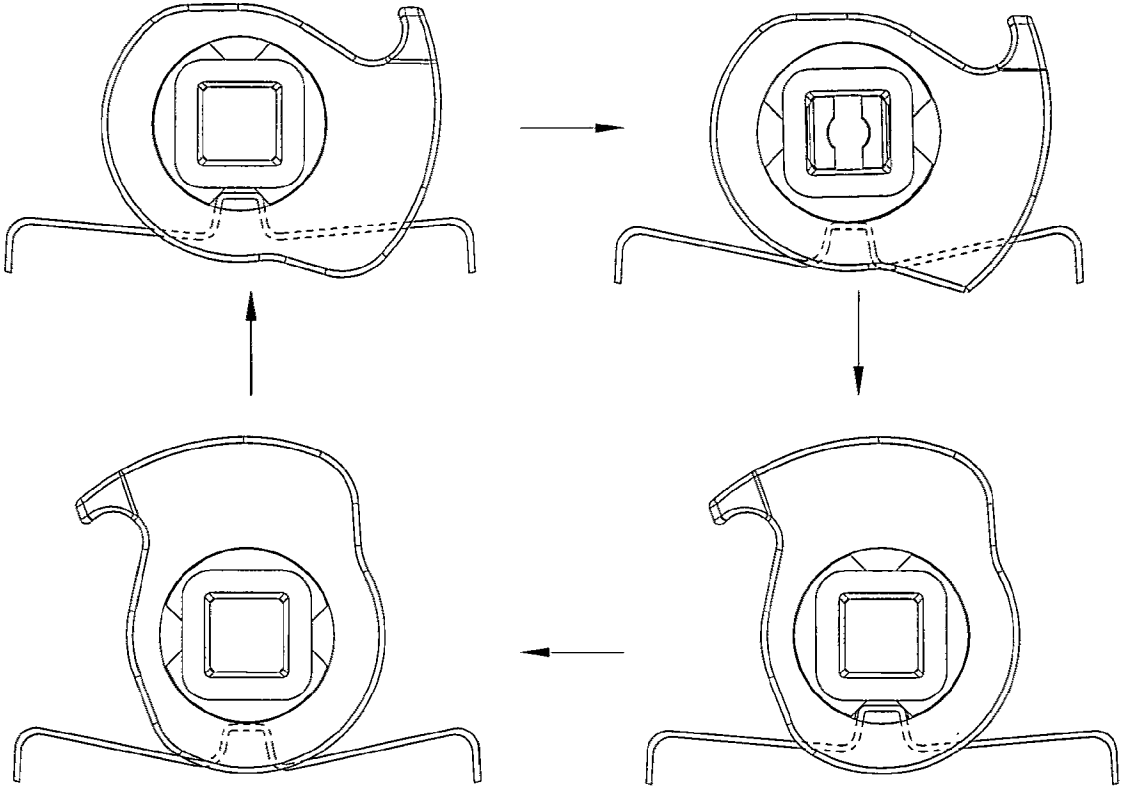
FIG. 17A-17D shows use of an alternate embodiment of locking spring that may be secured to the housing in two locations, and thus not be cantilevered.
Figures 18A, 18B, 18C, 18D:
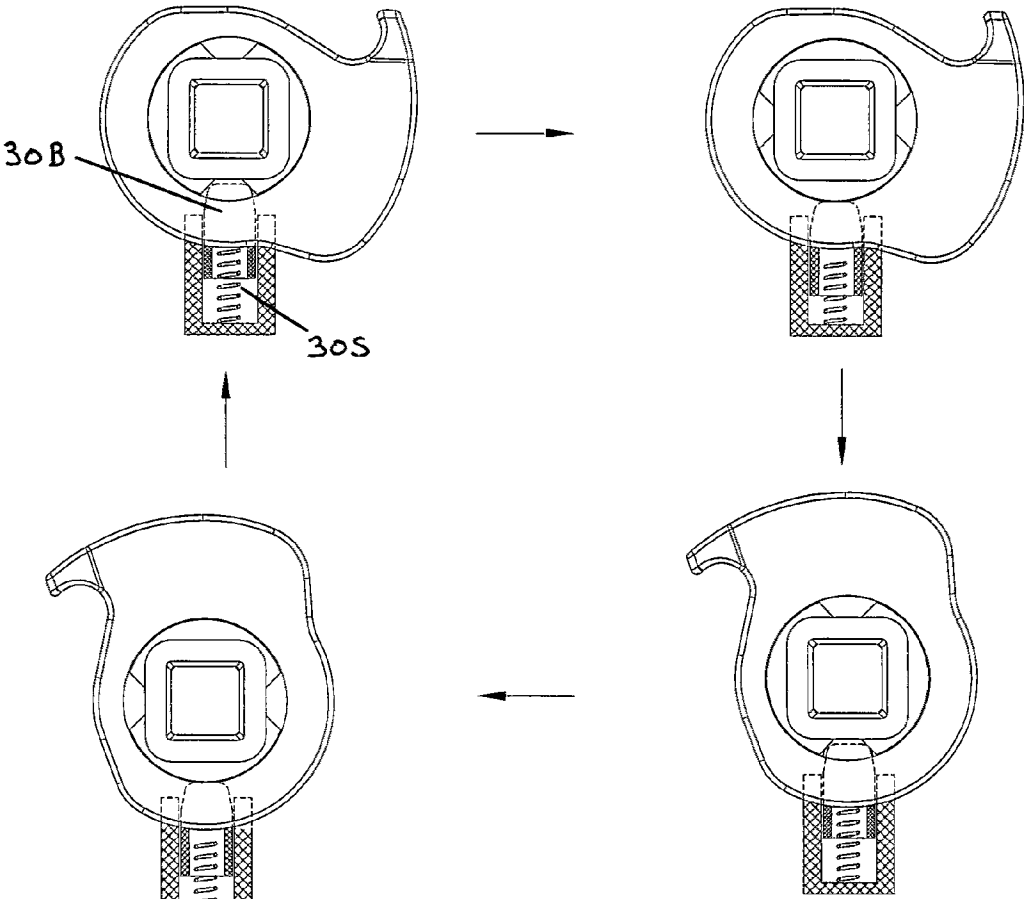
FIG. 18A-18D shows use of spring-loaded stop member usable as an alterative to the locking spring.
Figure 19:
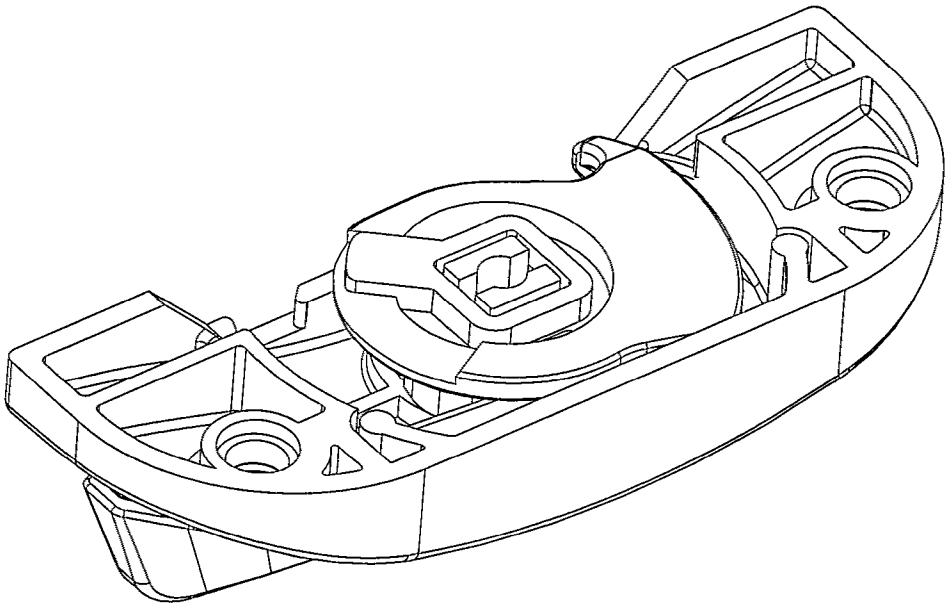
FIG. 19A-19F shows use of various shaped wedge members being used to slidably retain the delay cam within the locking cam.
Figure 19C:
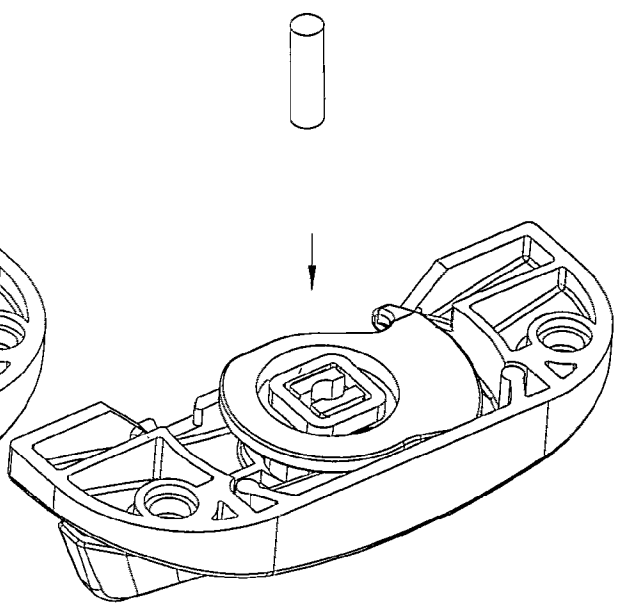
Figure 19B:
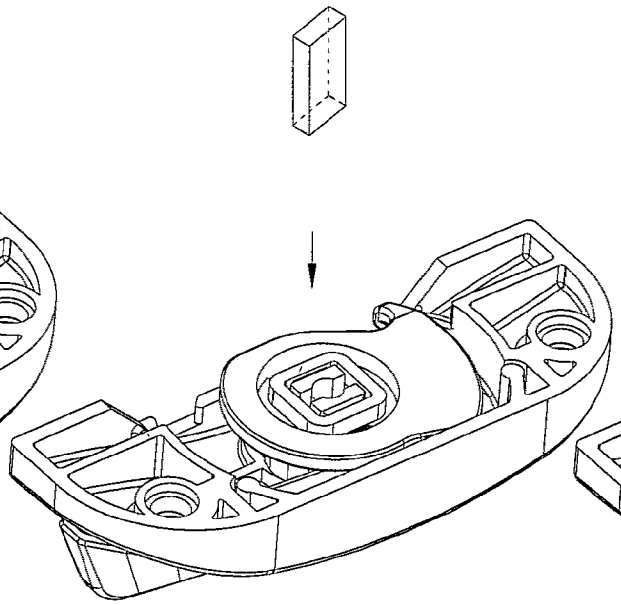
Figure 19A:
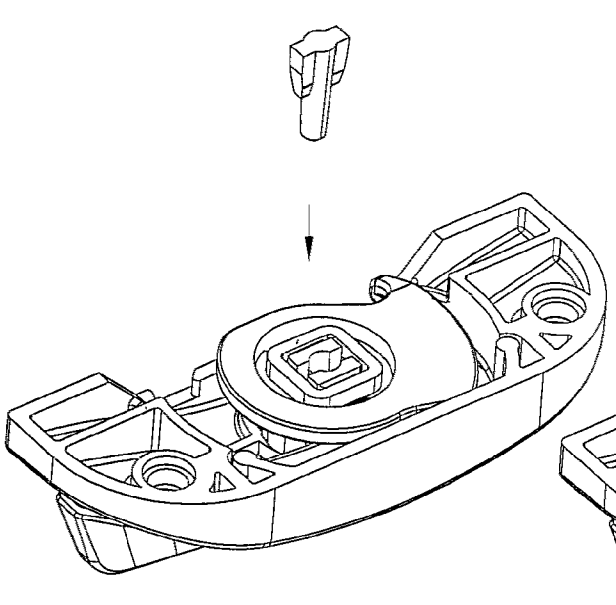
Figure 19F:
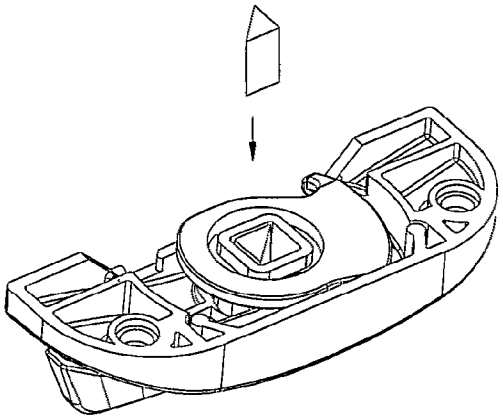
Figure 19E:
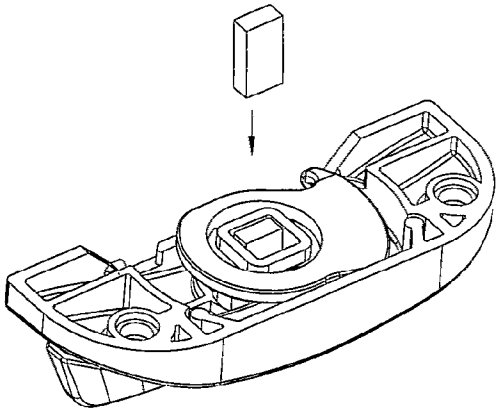
Figure 19D:
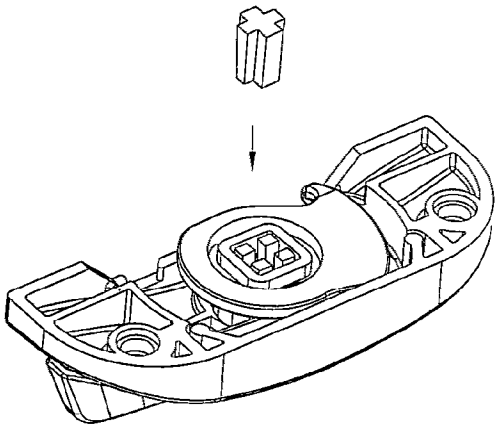

The housing 10 may be formed of a metallic material through a machining, forging or casting process, or may be made of a plastic material formed through an injection molding process, or it may be a laid-up composite part. The housing 10 may be formed to have only a single housing wall with an interior surface 12 and an exterior surface 11 (FIGS. 2 and 14), and may additionally have a boss 13E protruding upward from the exterior surface 11, along with a boss 13I protruding downward from the interior surface 12, and with an orifice 15 being centered thereon. Rather than the boss 13I, or in addition to the boss, integral stiffeners 13S may protrude down from the interior surface 12 to produce a flat mounting surface proximate to orifice 15, for the bottom of the latch 5. The integral stiffeners 13S on the bottom may also surround the latch mounting orifices 14, which may be recessed/spot-faced/countersunk on the exterior to permit use of a flush fastener or to prevent the head of a protruding head fastener from protruding above the exterior surface 11 after installation upon the window sash. Also, the stiffeners on the bottom may nonetheless result in a cavity below the orifice 15 to permit installation of the cams 40 and 60, as described hereinafter.

The shaft 20 may comprise one or more different cylindrical sections having different diameters. Shaft 20 may have a first cylindrical section 21 (FIG. 2) with a diameter sized to be rotatably/pivotally received within orifice 15 of the housing 10. A second larger diameter cylinder may be used to create a shoulder that may contact boss 13E to limit the depth of travel of the cylinder 21 into the housing orifice 15. The second cylinder may alternatively be a pan shaped member 22 that limits the travel (see FIG. 12). The second cylinder or the pan-shaped member 22 may be large enough to be grasped by the fingers of a user, and may also be knurled to further assist in such grasping, for the purpose of actuating the latch, or may have a knob attached thereto. The pan-shaped member 22 may also have a handle-portion 23 extending laterally therefrom to provide an easy means of applying a torque to the cylinder 21 to assist in causing rotation of the shaft. The handle-portion 23 may be mechanically secured to the pan-shaped member 22, or may be integrally formed therewith. Extending downward from the cylinder 21 may be a protrusion 24 having a rectangular cross-section that may have an opening 25 therein to create prongs 26 and 27, which, due to the opening 25, may exhibit some degree of flexibility. Extending from the outward facing side of prongs 26 and 27 may be a respective lip 26L and 27L.

Figure 2:
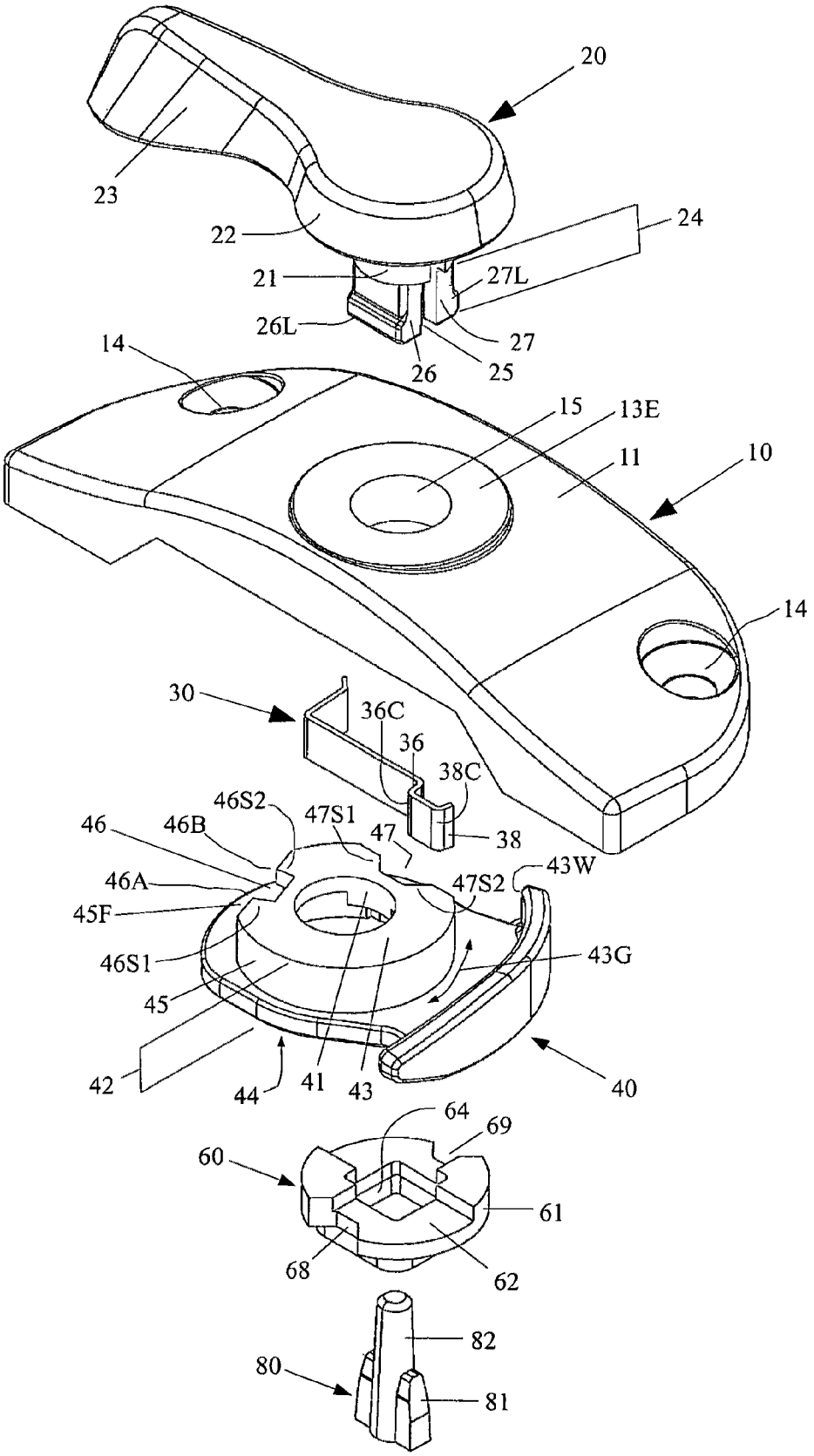
FIG. 2 is an enlarged view of the parts comprising the exploded view of FIG. 1.
Figure 6:
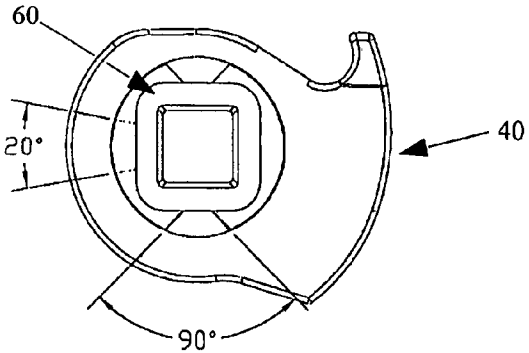
FIG. 6 is a perspective view of the delay cam assembled into the locking cam.
Figure 5:
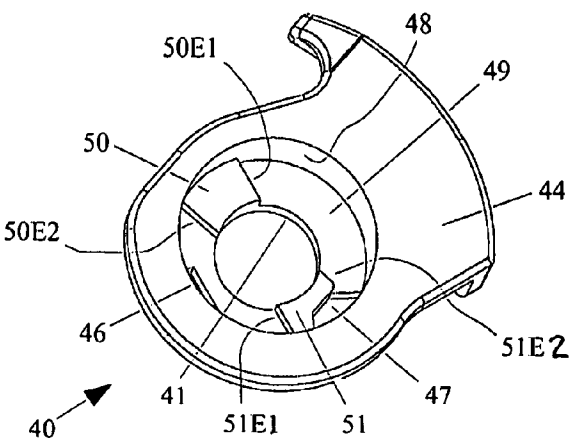
FIG. 5 is a perspective view of the locking cam of the present invention.
Figure 4A:
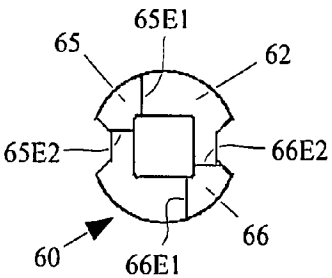
FIG. 4A is a top view of the delay cam of FIG. 4.

The locking cam 40 may have a thickness 42 forming a top surface 43 and bottom surface 44 (FIGS. 2 and 5). An orifice 41 may transverse the locking cam 40 between the top surface 43 and bottom surface 44, and a groove 43G may be cut through a portion of the thickness 42 to create an upstanding wall 43W, which may be used to engage a corresponding key on a keeper to lock the sash upon which the latch (5, 6, or 7) is mechanically fastened, using housing orifices 14. The formation of the groove 43G may also result in the forming of a cylindrical portion 45, which may be concentric with orifice 41. The cylindrical portion 45 may have a first opening 46 cut at a position opposite to (positioned approximately 180 degrees away from) the center of the wall 43W, and a second opening 47 cut at a position clocked midway between the first opening and the center of the wall (i.e., positioned 90 degrees away from the wall).

The first opening 46 may be generally trapezoidal-shaped, or may preferably be square-shaped having sharp edges 46A and 46B where the sides (46S1 and 46S2) of the opening meet the periphery of the cylinder 45. The edges may preferably be made even more sharply pronounced, as the sides 46S1 and 46S2 will be used to lock the locking cam 40, by adding a flat portion 45F to the cylinder 45 to be proximate to the opening 46. The second opening 47 may have its edges generously chamfered such that the sides (47S1 and 47S2) form a generally trapezoidal-shaped opening, as this opening may optionally be added to serve as a detent, to releasable restrain rotation of the locking cam 40 when the latch is in the unlocked position.

The bottom surface 44 of locking cam 40 may have an orifice 48 (FIG. 5) therein, with it being concentric to, and of a slightly smaller diameter than, the cylinder 45. The first opening 46 and a second opening 47 may each be of sufficient depth so as to have at least a portion of the openings penetrating through to the orifice 48. The orifice 48 may terminate in a flat bottom/end surface 49 that may generally be parallel to top surface 43. Protruding downward from the end surface 49 may be one or two or four or even more discrete protrusions, which may be integrally formed with, or mechanically fastened to, the end surface 49. In one embodiment (FIG. 5), a protrusion 50 may protrude down from end surface 49 on one side of the orifice 41 to create an engagement surface 50E1, and a second protrusion 51 may also protrude down from end surface 49 on an opposite side of orifice 41 to create an engagement surface 51E1.

This pair of engagement surface (50E1 and 51E1) of protrusions 50 and 51 may be used to drive the locking cam 40 to rotate from a first position, in which the latch is unlocked and with the locking cam being retracted within the housing cavity, to a second position, in which the latch is locked and being with a portion of the locking cam protruding out from the housing. Protrusions 50 and 51 may furthermore be formed to additionally create respective engagement surface 50E2 and 51E2, which may correspondingly be used to drive the locking cam to counter-rotate from the second position back to the first position.

While only two protrusions were used in this embodiment, it may be understood that four separate protrusions may alternatively be used to create the four engagement surfaces, whose functioning will be discussed later in detail. Also, the protrusions need not create flat engagement surfaces—the protrusions may also be cylindrical, or may be any other shape that is practical for driving the cam to rotate. Additionally, while a pair of opposingly positioned protrusions was cited in this embodiment to be used for driving rotation of the locking cam, it may be seen that only one protrusion may be used to either drive the locking cam's rotation or counter-rotation, although this may also result in the creation of a bearing force, rather than just a torque to cause rotation/counter-rotation.

Figure 12:
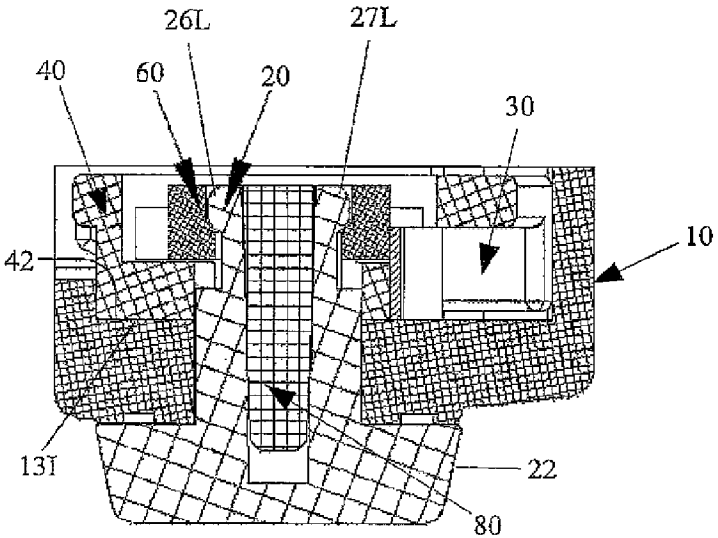
FIG. 12 is an enlarged view of the cross-section of FIG. 9.

With the shaft 20 being rotatably/pivotally mounted to the housing 10, by orifice 15 of the housing receiving the cylinder 21 of the shaft, the locking cam 40 may be inserted within the housing cavity and be mated with the shaft 20, with orifice 41 of the locking cam being rotatably received by the cylinder 21 of the shaft. The locking cam 40, as well as the shaft 20, may initially be clocked as shown within FIG. 2, to facilitate assembly of the latch for proper operation, which will become clear as the description proceeds. The locking cam 40 may be so inserted until the top surface 43 of the cam contacts the boss 13I on the interior surface 12 of housing 10 (FIGS. 2 and 12).

Figure 4C:
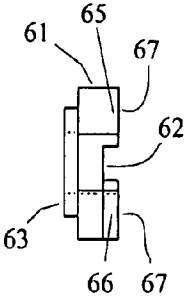
FIG. 4C is a side view of the delay cam of FIG. 4.
Figure 4B:
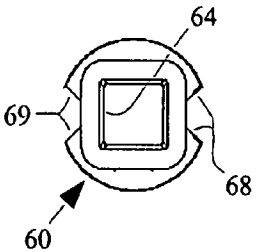
FIG. 4B is a bottom view of the delay cam of FIG. 4.
Figure 4:
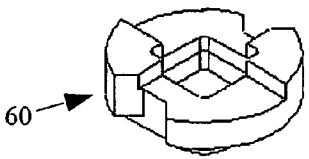
FIG. 4 is a perspective view of the delay cam of the present invention.
Figure 9:
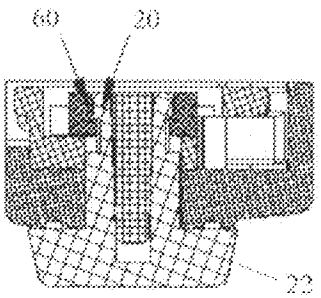
FIG. 9 is a cross-sectional view through the force entry resistance lock of FIG. 7, being taken along the short transverse direction.

The delay cam 60 may comprise a cylinder 61 with top and bottom surfaces 62 and 63. The cylinder 61 may be sized to be able to provide a clearance fit with the orifice 48 of the locking cam 40. The delay cam 60 may have a rectangular opening 64 between surfaces 62 and 63 that may correspond to the rectangular protrusion of shaft 20. Protruding upward from the top surface 63 may be one or two or four or even more discrete protrusions, which may correspond to the protrusions used on the locking cam 40. In an embodiment of the delay cam 60 being usable with the embodiment of the locking cam 40 described above, a first protrusion 65 protruding up from top surface 62 may create engagement surfaces 65E1 and 65E2, while a second protrusion 66 also protruding up from top surface 62, but on an opposite side of the surface, may create engagement surfaces 66E1, and 66E2. Both protrusions 65 and 66 may terminate in a flat upper surface 67 that may be generally parallel to top surface 62. The delay cam 60 may also have a first chamfered recess 68 in the side of the cylinder 61 (FIG. 4B), and a second chamfered recess 69 being located in the side of the cylinder to be approximately 180 degrees from the first recess. The recesses 68 and 69 may be generally trapezoidal-shaped to permit their use as a detent, as discussed hereinafter.

The delay cam 60 may be inserted into the cavity of housing 10 so as to have the prongs 26 and 27 of the protrusion 24 of the shaft 20 be received within the rectangular opening 64 of the delay cam, with the cylinder 61 of the delay cam be received within the orifice 48 of the locking cam, such that the first and second protrusions 65 and 66 of the delay cam are positioned between the first and second protrusions 50 and 51 of the locking cam, with the flat upper surface 67 of the protrusions of the delay cam contacting the bottom/end surface 49 of the locking cam 40. Also, if the height that the protrusions 65 and 66 protrude above top surface 62 of the delay cam matches the height that the protrusions 50 and 51 protrude down from bottom/end surface 49 of the locking cam, then the bottom planar surface of the protrusions 50 and 51 may also simultaneously contact top surface 62 of the delay cam 60. This pairing arrangement of protrusions will permit the delay cam 60 to selectively engage and drive rotation and counter-rotation of the locking cam 40 between the first and second positions.

The delay cam 60 may be fixedly secured to the shaft 20 by using mechanical fasteners or through the use of adhesive. The delay cam 60 may alternatively be secured to the shaft 20 by driving a wedge-shaped member 80 (FIG. 2) between the prongs 26 and 27 of the protrusion 24 of the shaft 20 to cause a lip on an end of at least one of the prongs to overhang the delay cam. In one embodiment, each of the two prongs 26 and 27 may have a corresponding lip 26L and 27L (FIG. 2) that may be driven by the wedge 80 to overhang the delay cam 60, as seen in FIG. 12. The wedge member 80 may be formed using a wedge shape 81; at the center of which may be a conical spike 82 that may further serve to cause separation of the prongs 26 and 27. Other alternative shapes available for the wedge member 80 are shown within FIGS. 19A through 19F, including a V-shape, a conical prong shape, a combination V-shape and conical prong shape (wedge-member 80 in FIG. 2), a conical cruciform, a block-shaped wedge, and a pyramid-shaped wedge.

Figure 7:
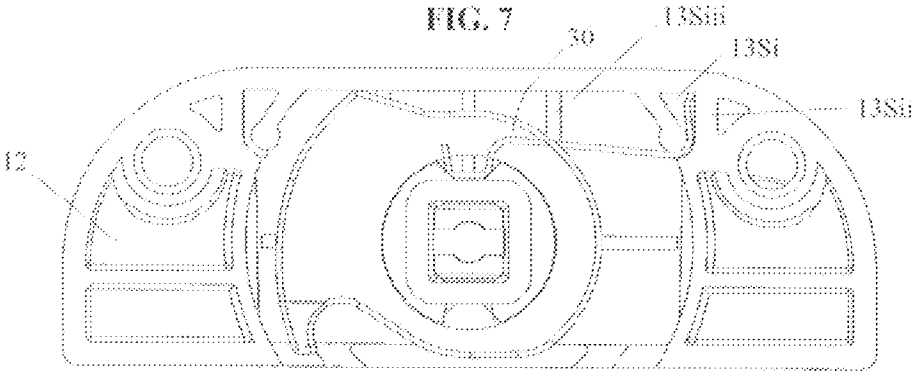
FIG. 7 is a bottom view of the force entry resistance lock of FIG. 1.

With this assembly of the housing 10, shaft 20, locking cam 40, delay cam 60, and wedge member 80, a bottom view of which is seen in FIG. 7, the locking spring member 30 may then be installed within the housing cavity.

Figure 3:
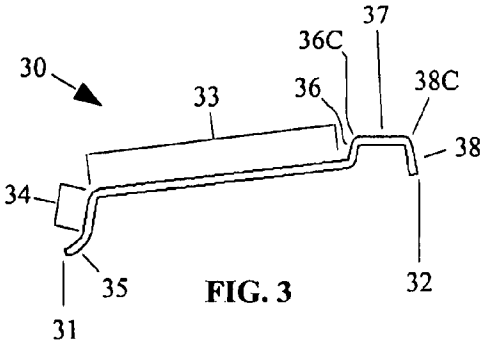
FIG. 3 is a side view of the locking spring member of the current invention.

The locking spring 30 (FIG. 3) may comprise a flexible cantilevered member having a first end 31 and second end 32, and having a generally straight portion 33 that may bend proximate to the first end 31 to form a short section 34 that terminates in a crimped portion 35. Part-way between the first end 31 and the second end 32, the generally straight portion 33 may transition into a series of turns to form a generally rectangular shape, and which may include a first leg 36, a connector 37, and a second leg 38 that terminates at the second end 32. First leg 36 may have a small straight ("chamfered") transition 36C into connector 37, and similarly connector 37 have a small straight ("chamfered") transition 38C into second leg 38. The first leg 36 and second leg 38 may be generally parallel to each other or nearly so, in order to permit engagement of those series of turns with the first opening 46 in the cylindrical portion 45 of the locking cam 40 to inhibit rotation of the cam, when the latch is in the locked position. The locking spring 30 may be made of a flexible metallic material to produce a desired amount of biasing. (Note that an alternative to the locking spring 30 may be the biasing member 30B in FIGS. 18A-18D which is biased by a helical spring 30S out from a recess in the housing or out from a separate member that is attached to the housing cavity).

Figure 8:
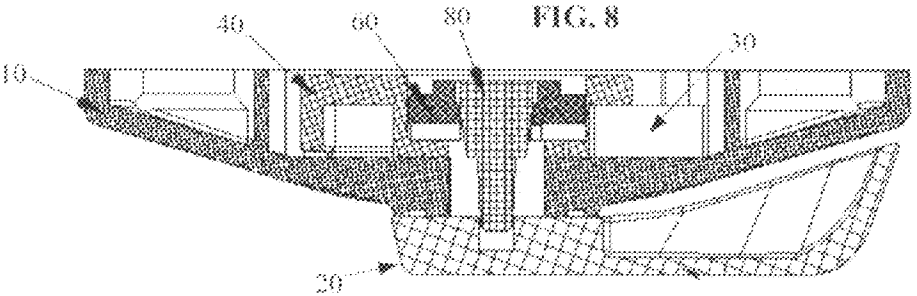
FIG. 8 is a cross-sectional view through the force entry resistance lock of FIG. 7, being taken along the long transverse direction.

The locking spring 30 being so formed may be installed within the housing cavity, as seen in FIGS. 7-8, such that the first end 31 is secured within the integral stiffeners 13S, by having the bend into the short section 34, the short section 34, and the crimped portion 35 being pinched between two of the integral walls, 13Si and 13Sii. Stiffener 13Sii may have a bulb on its end to aptly contact the bend, and stiffener 13Si may have a curved portion to similarly provide support. The generally straight portion 33 may also be supported by a third integral stiffener 13Siii to prevent excessive backward movement of the locking spring 30 during movement of the cams, or alternatively, a thicker spring may be used, or even a stiffer material may be used for the spring, such as steel rather than aluminum. The second end of the locking spring 30 may thus be biased into contact with at least a portion of the cylinder 45 of the locking cam 40. The actual movement of the cams and selective engagement therebetween with the coordinated biasing of the locking spring for locking and/or detent securing of the cams is as follows.

Figure 13B:
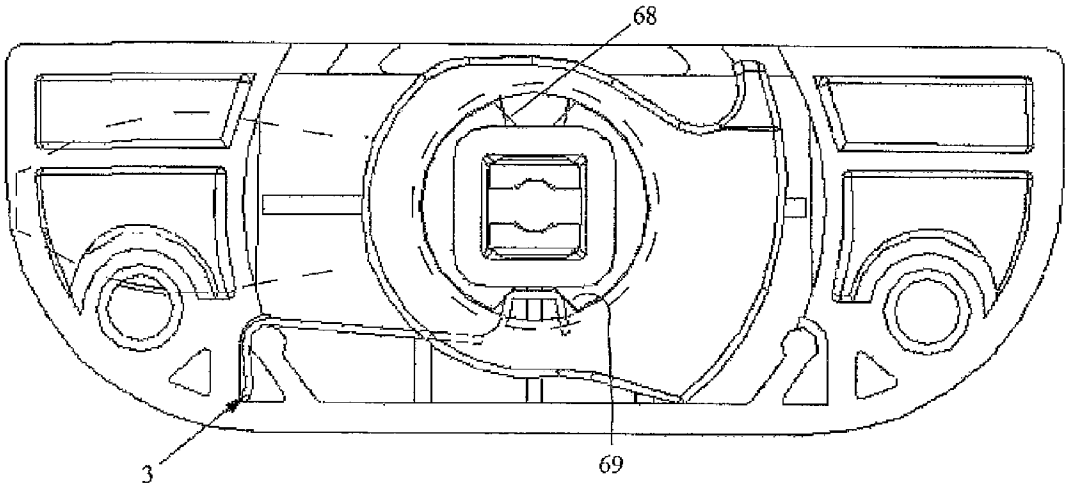
FIG. 13B is the enlarged bottom view of FIG. 13A, but being shown with the locking cam in the extended/locked position.

With the latch (5, 6, or 7) in the locked position (FIG. 13D and FIG. 13A), the first leg 36, connector 37, and second leg 38 of the second end of the locking spring 30 are nested securely within the first opening 46 of the locking cam, such that the first leg 36 contacts the side 46S1 of the opening, and the second leg 38 contacts the side 46S2 of the opening (see also FIG. 2), to thereby inhibit rotation of the locking cam. The locking cam 40 is thus locked when it occupies the second position and the latch is to remain locked until actuated using the handle from the interior, thereby preventing any attempt at using a lock picking device to gain unwanted entry. The delay cam 60 is also detent secured at the latch locked position, as the second end of the locking spring 30 is also releasably engaging the first chamfered recess 68 of the delay cam, because the length of the legs 36 and 38 of the locking spring 20 is sufficiently greater than the thickness of the cylinder wall formed by the outer diameter of cylinder 45 and the inner diameter of orifice 48 of the locking cam 40.

This engagement with the first chamfered recess 68 of the delay cam 60 is crucial for the operation and sequencing of the respective rotations/counter-rotations of the cams, as will be discussed next. Therefore, to successfully practice the invention, in manufacturing the locking cam 40 and locking spring 30, it is necessary to carefully calibrate the depth of penetration (length) of the locking spring legs 36 and 38, with the thickness of the locking cam 40 wall, as well as the angle between the legs, if a slight trapezoidal shape is used instead of a square shape (parallel legs).

Figure 10:
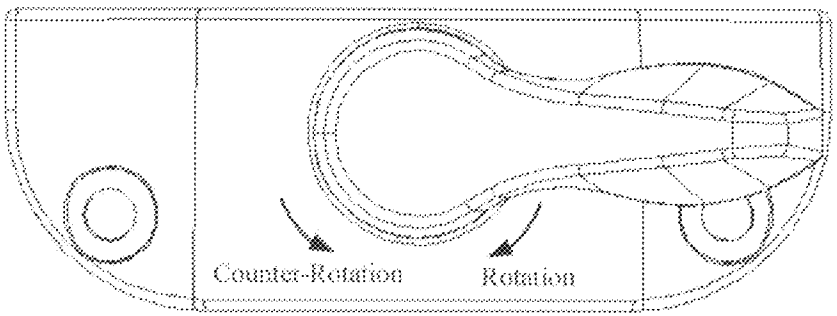
FIG. 10 is a top view of the forced entry resistance lock of FIG. 1.
Figure 11:
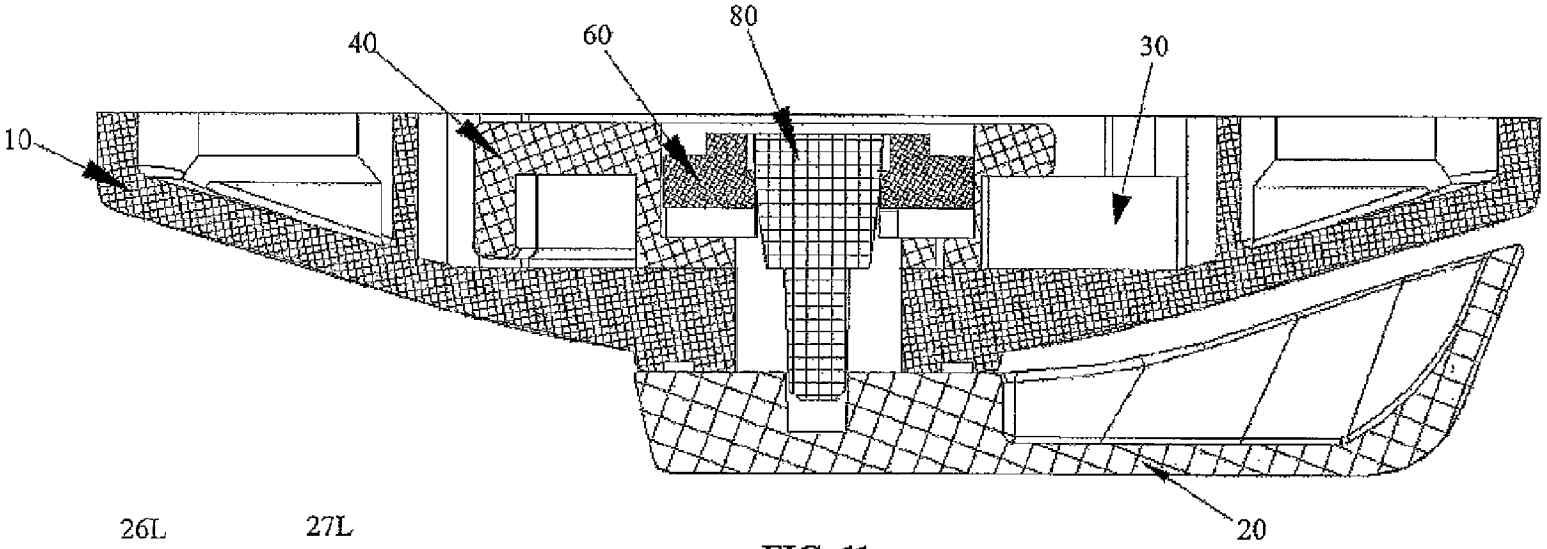
FIG. 11 is an enlarged view of the cross-section of FIG. 8.
Figure 13A:
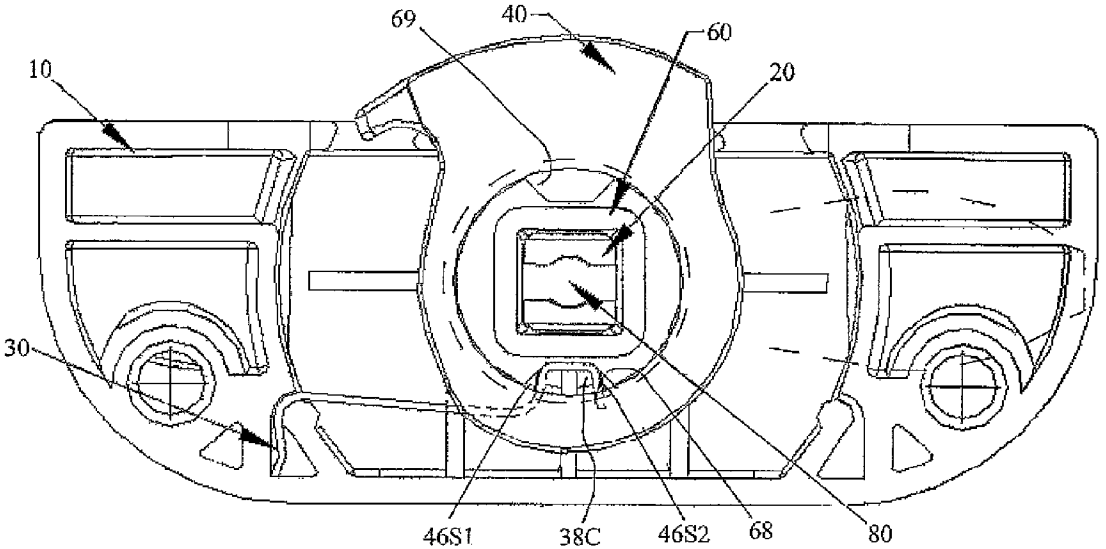
FIG. 13A is an enlarged bottom view of the forced entry resistance lock of FIG. 1, shown with the locking cam in the retraced/unlocked position.
Figure 13C:
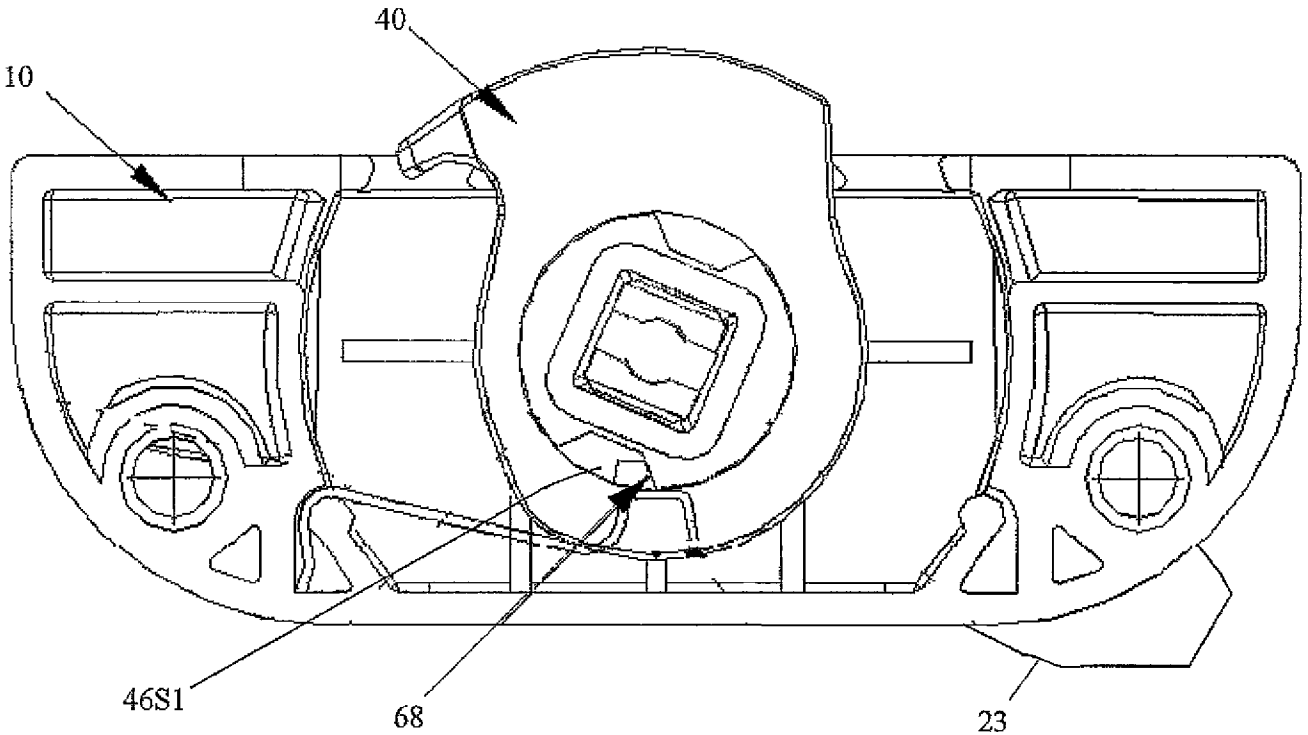
FIG. 13C is the enlarged bottom view of FIG. 13A, but being shown with the handle counter-rotated to cause disengagement of the locking spring from the delay spring detent.

It should be noted that herein, the term "rotation" is used to describe the clock-wise revolution of the shaft/handle and cams, as seen from a view looking down on the latch (see FIG. 10), while the term "counter-rotation" is used to conversely describe counter-clockwise revolution from the same plan view. Therefore, to unlock the latch, the handle 23 of shaft 20 may be counter-rotated, which causes corresponding counter-rotation of the delay cam 60, since they are mechanically connected as previously described. As seen in FIG. 13A, counter-rotation of the delay cam 60 results in the angled side of the first chamfered opening 68 of the delay cam 60 contacting the small straight ("chamfered") transition 38C between second leg 38 and connector 37 of the locking spring 30, resulting in the delay cam 60 countering the bias of the locking spring 30, to back off the spring until the connector 37 is then biased into contact with the delay cam cylinder 61 (see FIG. 13C). The change to the locking spring may be seen by comparing its appearance in FIGS. 13D and 13E.

With the spring so positioned and biased, the small straight ("chamfered") transition 38C between second leg 38 and connector 37 of the locking spring 30 may then be contacting the edge 46B of the locking cam 40, which is formed where the sides 46S2 of the opening meets the periphery of the cylinder 45 or the flat 45F. This contact serves as a detent to releasably restrain the locking cam from potential counter-rotation due to frictional contact. Once the handle 23 of shaft 20 is counter-rotated approximately 85 to 90 degrees, as seen in FIG. 13E, engagement surfaces 65E2 and 66E2 of protrusions 65 and 66 of delay cam 60 will then engage the engagement surfaces 50E2 and 51E2 of the locking cam 40, respectively, and as such, continued counter-rotation of the shaft/handle and delay cam will cause driven counter-rotation of the locking cam 40. As the delay cam 60 begins to cause driven counter-rotation of the locking cam, the small straight ("chamfered") transition 38C of the locking spring contacting the edge 46A of the locking cam 40 serves to counter the bias of the locking spring 30 to back off the spring until the connector 37 is then biased into contact with the locking cam cylinder 45. Further counter-rotation of the shaft/handle and delay cam will result in driven counter-rotation of the locking cam for approximately 90 to 95 degrees, and will place the latch in the unlocked position, as seen in FIG. 13G. Total rotation/counter-rotation of the handle 23 of shaft 20 between the locked and unlocked latch positions may, but need not necessarily be, approximately 180 degrees. Also, total rotation/counter-rotation of the locking cam between the retracted and extended positions, because of the sizing and positioning of the protrusions 65 and 66 on the delay cam and the protrusions 50 and 51 on the locking cam, may, but need necessarily be, approximately 90 degrees.

Upon reaching the latch unlocked position (FIG. 13B), the retracted locking cam 40 may be detent secured by the trapezoidal shaped second opening 47 therein releasably receiving the locking spring 30 second end 32. The delay cam 60 may also be detent secured by the second chamfered recess 69 then being clocked to be aligned with the locking cam second opening 47, so as to also releasably receive the locking spring 30 second end 32.

Rotation of the handle 23 of shaft 20 to conversely place the latch in the locked condition from the unlocked condition proceeds in the opposite sequence (see the sequence of FIGS. 16D, 16E, 16F, and 16A). Delay cam rotation resulting from rotation of the handle from the first position to the second position will result in the delay cam selectively engaging and driving the locking cam. Initially, a first portion of the rotation of the delay cam will be without driven rotation of the locking cam, but a second portion of the rotation of the delay cam will, when engagement surfaces 65E1 and 66E1 of protrusions 65 and 66 of delay cam 60 respectively engage the engagement surfaces 50E1 and 51E1 of the locking cam 40, cause driven rotation of the locking cam to thereby drive the locking cam from the retracted position into the extended position, being with a portion of the locking cam protruding out from the housing cavity.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A window latch comprising:

a housing, said housing comprising a cavity and an orifice into said cavity;

a shaft, said shaft being rotatably mounted in said housing orifice with a portion of said shaft protruding into said housing cavity, and a portion protruding out from said housing;

a locking cam, said locking cam comprising an orifice, said orifice of said locking cam being rotatably received upon said shaft within said housing cavity;

a delay cam, said delay cam being fixed to a portion of said shaft within said housing cavity, to be rotatable therewith, and with a portion of said delay cam being configured to selectively engage and drive said locking cam to rotate between a first position, in which said locking cam is retracted within said housing and said latch is unlocked, and a second position, in which a portion of said locking cam extends out from said housing and said latch is thereby configured to be locked; said delay cam configured to selectively engage and drive said locking cam to rotate from said first position to said second position comprising:

a first portion of said rotation of said delay cam being without driven rotation of said locking cam; and a second portion of said rotation of said delay cam configured to cause corresponding rotation of said locking cam to drive said locking cam from said retracted position into said extended position;

and a locking spring, said locking spring having a first end and a second end; said first end being secured to said housing within said cavity; said second end being biased into contact with said locking cam, said biased locking spring configured to engage a first opening in said locking cam to thereby lock said locking cam relative to said housing, upon said locking cam reaching said second position; said engagement of said second end of said locking spring with said locking cam being to a depth to further permit engagement of said spring therein with a first chamfered recess in said delay cam to thereby serve as a detent to releasably retain said delay cam and shaft in said second position.

2. A window latch according to claim 1, wherein said second portion of said rotation of said delay cam being configured to cause driven rotation of said locking cam is by a protrusion on said delay cam being positioned thereon to engage a protrusion on said locking cam after said first portion of said shaft/delay cam rotation.

3. A window latch according to claim 2, wherein said first portion of said corresponding rotation of said delay cam comprises approximately 85 to 90 degrees of rotation.

4. A window latch according to claim 3, wherein said first and second portions of said corresponding rotation of said delay cam comprises approximately 180 degrees of rotation; and wherein said locking cam rotation between said retracted and said extended position comprises approximately 90 degrees of rotation.

5. A window latch according to claim 4, wherein said delay cam selectively engaging and driving said locking cam further comprises, upon counter-rotation of said shaft and delay cam from said second position to said first position:

a first portion of said counter-rotation of said delay cam being without driven counter-rotation of said locking cam, said first portion of said delay cam counter-rotation initially being with said first chamfered recess counter-rotating to cause partial disengagement of said locking spring second end from said locking cam first opening, said partial disengagement resulting in an angled surface of said locking spring contacting an edge of said locking cam first opening to serve as a detent; and a second portion of said counter-rotation of said delay cam causing corresponding counter-rotation of said locking cam and complete disengagement of said locking spring from said edge of said locking cam, to thereby drive said locking cam from said extended position into said retracted position.

6. A window latch according to claim 5, wherein said second portion of said counter-rotation of said delay cam causing driven counter-rotation of said locking cam is by a second protrusion on said delay cam being positioned thereon to engage a second protrusion on said locking cam after said first portion of said corresponding shaft/delay cam counter-rotation.

7. A window latch according to claim 6, wherein said first portion of said corresponding counter-rotation of said delay cam comprises approximately 85 to 90 degrees of counter-rotation.

8. A window latch according to claim 7, wherein said first and second portions of said corresponding counter-rotation of said delay cam comprises approximately 180 degrees of counter-rotation.

9. A window latch according to claim 8, wherein said locking cam further comprises a second opening to receive said locking spring second end to form a detent; and wherein when said locking cam is driven into said retracted position, said biased second end of said locking spring engages said second opening in said locking cam, said second opening being chamfered to permit said locking spring second end to be releasable therefrom upon rotation of said shaft.

10. A window latch according to claim 9, wherein said delay cam further comprises a second recess; and wherein when said locking cam is driven into said retracted position, said biased second end of said locking spring engages said second opening in said locking cam to a depth to further permit engagement of said spring therein with said second recess of said delay cam, said second recess being chamfered to permit said locking spring second end to be releasable therefrom upon rotation of said shaft.

11. A window latch according to claim 10, wherein said delay cam being fixed to said shaft comprises a rectangular protrusion on said shaft having an opening therein to create a pair of prongs, and said protrusion being received in a corresponding orifice in said delay cam; and wherein said fixing comprises a wedge-shaped member being driven between said prongs to cause a lip on an end of at least one of said prongs to overhang said delay cam, said wedge shaped member being from the group of wedge shapes consisting of: a V-shape, a conical prong shape, a conical cruciform.

12. A window latch according to claim 11, wherein said shaft comprises one or more concentrically formed cylinders of different diameters.

13. A window latch according to claim 12, wherein said protruding portion of said locking cam comprises a slot therein.

14. A window latch according to claim 13, wherein said first opening in said locking cam comprises a rectangular opening.

15. A window latch, for use in securing one or more window sashes slidably disposed within a window master frame, said latch comprising:

a housing, said housing comprising a cavity and an orifice;

a shaft, said shaft being rotatably mounted within said housing orifice with a portion of said shaft protruding into said housing cavity, and a portion protruding out from said housing;

a locking cam, said locking cam comprising an orifice, said orifice of said locking cam being received upon said shaft within said housing cavity, said locking cam being rotatable thereon; and a delay cam, said delay cam being fixed to a portion of said shaft within said housing cavity, to be rotatable therewith, and with a portion of said delay cam being configured to selectively engage and drive said locking cam to rotate between a first position, in which said locking cam is retracted within said housing and said latch is unlocked, and a second position, in which a portion of said locking cam extends out from said housing and said latch is thereby configured to be locked; said delay cam configured to selectively engage and drive said locking cam to rotate from said first position to said second position comprising:

a first portion of said rotation of said delay cam being without driven rotation of said locking cam; and a second portion of said rotation of said delay cam configured to cause corresponding rotation of said locking cam to drive said locking cam from said retracted position into said extended position;

and a locking spring, said locking spring having a first end and a second end; said first end being secured to said housing within said cavity to thereby permit biasing of said second end; said second end being biased into contact with said locking cam, said biased locking spring configured to engage a first opening in said locking cam to thereby lock said locking cam relative to said housing upon said locking cam reaching said second position; said engagement of said second end of said locking spring with said locking cam being to a depth to further permit engagement of said spring therein with a first chamfered recess in said delay cam to thereby serve as a detent to releasably retain said delay cam and shaft in said second position.

16. A window latch according to claim 15, wherein said second portion of said corresponding rotation of said delay cam being configured to cause corresponding rotation of said locking cam is by a protrusion on said delay cam being positioned thereon to engage a protrusion on said locking cam after said first portion of said corresponding shaft/delay cam rotation.

17. A window latch according to claim 16, wherein said first portion of said rotation of said delay cam comprises approximately 85 to 90 degrees of rotation; wherein said first and second portions of said rotation of said delay cam comprises approximately 180 degrees of rotation; and wherein said locking cam rotation between said retracted and said extended position comprises approximately 90 degrees or rotation.

18. A window latch according to claim 17, wherein said delay cam configured to selectively engage and drive said locking cam further comprises, upon counter-rotation of said shaft from said position corresponding to said latch locked position to said position corresponding to said latch unlocked position, corresponding counter-rotation of said delay cam;

wherein a first portion of said counter-rotation of said delay cam is without driven counter-rotation of said locking cam, said first portion of said delay cam counter-rotation initially being with said first chamfered recess counter-rotating to cause partial disengagement of said locking spring second end from said locking cam first opening, said partial disengagement resulting in an angled surface of said locking spring contacting an edge of said locking cam first opening to serve as a detent; and wherein a second portion of said corresponding counter-rotation of said delay cam causes corresponding counter-rotation of said locking cam and complete disengagement of said locking spring from said edge of said locking cam, to thereby drive said locking cam from said extended position into said retracted position.

19. A window latch according to claim 18, wherein said second portion of said counter-rotation of said delay cam causing corresponding counter-rotation of said locking cam is by a second protrusion on said delay cam being positioned thereon to engage a second protrusion on said locking cam.

20. A window latch according to claim 19, wherein said first portion of said counter-rotation of said delay cam comprises approximately 85 to 90 degrees of counter-rotation; and wherein said first and second portions of said counter-rotation of said delay cam comprises approximately 180 degrees of counter-rotation.

21. A window latch according to claim 15, wherein said locking cam further comprises a second opening to receive said locking spring second end to form a detent; and wherein when said locking cam is in said retracted position, said biased second end of said locking spring engages said second opening in said locking cam, said second opening being chamfered to permit said locking spring second end to be releasable therefrom upon rotation of said shaft.

22. A window latch according to claim 21, wherein said delay cam further comprises a second recess; and wherein when said locking cam is in said retracted position, said biased second end of said locking spring engages said second opening in said locking cam to a depth sufficient to further permit engagement of said spring therein with said second recess of said delay cam, said second recess being chamfered to permit said locking spring second end to be releasable therefrom upon rotation of said shaft.

23. A window latch according to claim 15, wherein a graspable handle is mechanically secured to, or integrally formed with, said portion of said shaft protruding from said housing, said graspable handle providing leverage for said rotation of said shaft to cause said corresponding rotation of said delay cam.

24. A window latch according to claim 15, wherein said delay cam being fixed to said shaft comprises a rectangular protrusion on said shaft having an opening therein to create a pair of prongs, and said protrusion being received in a corresponding orifice in said delay cam; and wherein said fixing comprises a wedge-shaped member being driven between said prongs to cause a lip on an end of one of said prongs to overhang said delay cam.

25. A window latch according to claim 15, wherein said shaft comprises one or more concentrically formed cylinders of different diameters.

26. A window latch according to claim 16, wherein said protruding portion of said locking cam comprises a slot therein, said slot being configured to engage with a key of a keeper.

* * * * *